US007067776B2

(12) United States Patent
Michelmann

(10) Patent No.: US 7,067,776 B2
(45) Date of Patent: Jun. 27, 2006

(54) MONITORING DEVICE FOR FLEXIBLE HEATING ELEMENTS

(75) Inventor: Jochen Michelmann, Gelnhausen (DE)

(73) Assignee: I.G. Bauerhin GmbH, Grundau (DE)

( * ) Notice: Subject to any disclaimer, the term of this patent is extended or adjusted under 35 U.S.C. 154(b) by 0 days.

(21) Appl. No.: 11/137,354

(22) Filed: May 24, 2005

(65) Prior Publication Data

US 2005/0263519 A1 Dec. 1, 2005

(30) Foreign Application Priority Data

May 29, 2004 (DE) ..... 10 2004 026 458

(51) Int. Cl.
*H05B 3/34* (2006.01)

(52) U.S. Cl. ..... 219/549; 219/490

(58) Field of Classification Search ..... 219/200–212, 219/520, 527–529, 538–545, 548–549, 490, 219/494, 507–510, 517; 174/107; 139/425 R
See application file for complete search history.

(56) References Cited

U.S. PATENT DOCUMENTS

| | | | | |
|---|---|---|---|---|
| 3,472,289 | A * | 10/1969 | Riordan et al. | 139/425 R |
| 4,538,054 | A * | 8/1985 | de la Bretoniere | 219/545 |
| 4,983,814 | A * | 1/1991 | Ohgushi et al. | 219/545 |
| 5,422,462 | A * | 6/1995 | Kishimoto | 219/545 |
| 6,403,935 | B1 * | 6/2002 | Kochman et al. | 219/545 |
| 6,713,733 | B1 * | 3/2004 | Kochman et al. | 219/549 |

FOREIGN PATENT DOCUMENTS

| | | |
|---|---|---|
| DE | 41 01 290 C2 | 7/1992 |
| DE | 90 07 519.6 | 7/1992 |
| DE | 198 31 574 C2 | 1/2000 |

* cited by examiner

*Primary Examiner*—Tu Hoang
(74) *Attorney, Agent, or Firm*—Darby & Darby

(57) ABSTRACT

The invention concerns a controlling and monitoring device for avoiding damage through overheating in the case of flexible, textile surface heating elements which include at least two opposed contact conductors (3.1, 3.2) made of electrically conducting, non-insulated fibers or wires between which there extends a plurality of heating conductors (8) which are electrically connected to the contact conductors (3.1, 3.2) and to a current-voltage source. At least one additional conductor (1) is guided along at least one contact conductor over the heating conductors (8), wherein the additional conductor (1) is electrically insulated by a covering material and is connected to an electric or electronic evaluation switch (11). The coating material has a softening range which is above the standard heating temperature of the surface heating element, but below the permissible thermal limit temperature of the surrounding materials and of the base material (12), wherein, in the case of overheating, the coating material melts and wherein the heating conductors (8.1, 8.2), together with the additional conductor, form an electrical contact via which, for the purpose of controlling any overheating, an electric current flows to the electric or electronic evaluation unit which is connected to the current-voltage source.

10 Claims, 2 Drawing Sheets

MONITORING DEVICE FOR FLEXIBLE HEATING ELEMENTS

The present invention relates to a controlling and monitoring device for avoiding overheating in the case of flexible, textile surface heating elements which consist of at least two opposed contact conductors made from electrically conductive, non-insulated fibers or wires between which there extends a plurality of heating conductors which are electrically connected to the contact conductors.

BACKGROUND

DE 4 101 290 and DE 19 831 574 describe textile surface heating elements having at least two opposed strips made of electrically conductive, non-insulated fibers or wires between which there extends a plurality of non-insulated heating conductors consisting of an electric resistance material.

This type of heating element is primarily used for heating seats in motor vehicles. Because of chemical and mechanical influences such as water, salt and movement on the seats, both the heating conductors and the contact conductors are attacked and locally destroyed in the course of time.

If part of the contact conductors are destroyed, a transition resistance occurs which generates heat along the heating strips which may lead to impermissible heating of the heating element.

DE 4 101 290 and G 90 075 19 disclose a heating element whose mechanical service life is intended to be prolonged by contact strips extending in a wave-like fashion. This arrangement reduces the problem of overheating, but does not eliminate it. To prevent corrosive attacks on metallic conductors, there are known surface coatings made of silver and tin, but they can be destroyed by electro-corrosion if salt and moisture are present in the presence of an electric voltage.

The destruction mechanism develops in such a way that either the contact conductors break as a result of constant bending and movement, as a result of which the cross-section of the contact conductors is tapered in the bent region, or the contact conductors are chemically attacked causing decomposition, or the transition resistance of the heating conductor acting on the contact conductors is increased, so that heating is increased. The installation of temperature sensors can not prevent the thermal problems affecting the contact conductors.

It is therefore the object of the present invention to develop a monitoring device of the above-mentioned type which prevents the heating conductors from becoming so hot in the vicinity of the contact conductors that the permissible thermal limit temperature of the surrounding materials is exceeded.

SUMMARY OF INVENTION

In accordance with the invention, the objective is achieved by providing a controlling and monitoring device for avoiding damage through overheating in the case of flexible, textile surface heating elements which consist of at least two opposed contact conductors made of electrically conducting, non-insulated fibers or wires between which there extends a plurality of heating conductors which are electrically connected to the contact conductors, wherein an additional conductor is placed over the heating conductors and connected to an evaluation unit that cooperates with a current-voltage source for the heating conductors in order to avoid overheating.

The additional conductor carries an insulation made of plastic or paint which, if used as specified, does not melt and thus prevents the heating conductor and the additional conductor from coming into electrical contact. An embodiment wherein a detection conductor in the form of an additional conductor monitors two or more contact strips is also conceivable, wherein the detection conductor is guided by the contact conductor along the heating conductors as far as the nearest contact conductor.

If, somewhere in the region of the detection conductor, there is generated a sufficiently high temperature in the region of the contact conductors or the heating conductors extending over the contact conductors, the insulation melts and the detection conductor comes into an electrical contact with the non-insulated heating and/or contact conductors positioned underneath.

The electrical connection is recorded by the evaluation unit, e.g. a distant control unit and the heating element is disconnected from the current-voltage source before a fire occurs. Preferably, the control unit also constitutes the regulating unit for the operating temperature of the heating element.

In a preferred embodiment, the contact conductors comprise multiple strands of metallic wire and the heating conductors comprise wave-shaped carbon fibers which contact one another at spaced contact points. These characteristics permit the safe operation of heating elements with metallic contact conductors and inter-connected heating conductors consisting of carbon fiber. As these generate high temperatures in the case of defective regions at the contact strip, the high melting temperature of the carbon fiber can lead to considerable damage.

In the preferred embodiment, the additional conductor includes a filament made of steel. This ensures that it is able to withstand the mechanical bending and upsetting loads and is not destroyed in the region of the contact conductor. In accordance with the invention, this is achieved by a steel conductor which has only moderate conducting characteristics, but which features an excellent mechanical stability.

The heating conductors and the contact conductors may be knitted into a textile base material with the additional conductor applied to the heating conductors in the base material. Alternatively, the heating conductors, contact conductors and additional conductor may be sewn onto a textile base material. This ensures that the insulation is not damaged during the production process because in certain knitting processes, use is made of needles with very sharp points which could damage the insulation. Carbon fibers, in particular, are pulled by the needles through the insulation as far as the conductor, so that an undesirable electrical contact is established.

In an alternative embodiment, the additional conductor extends in the form of a wave or it may consist of a textile thread enveloped by one or more electrically conductive metal strips, with insulation over the metal strips. These arrangements tend to prevent the additional conductor from being destroyed as a result of mechanical loads.

Below, the invention will be explained with reference to several embodiments.

THE DRAWINGS

DETAILED DESCRIPTION

Figure 1:
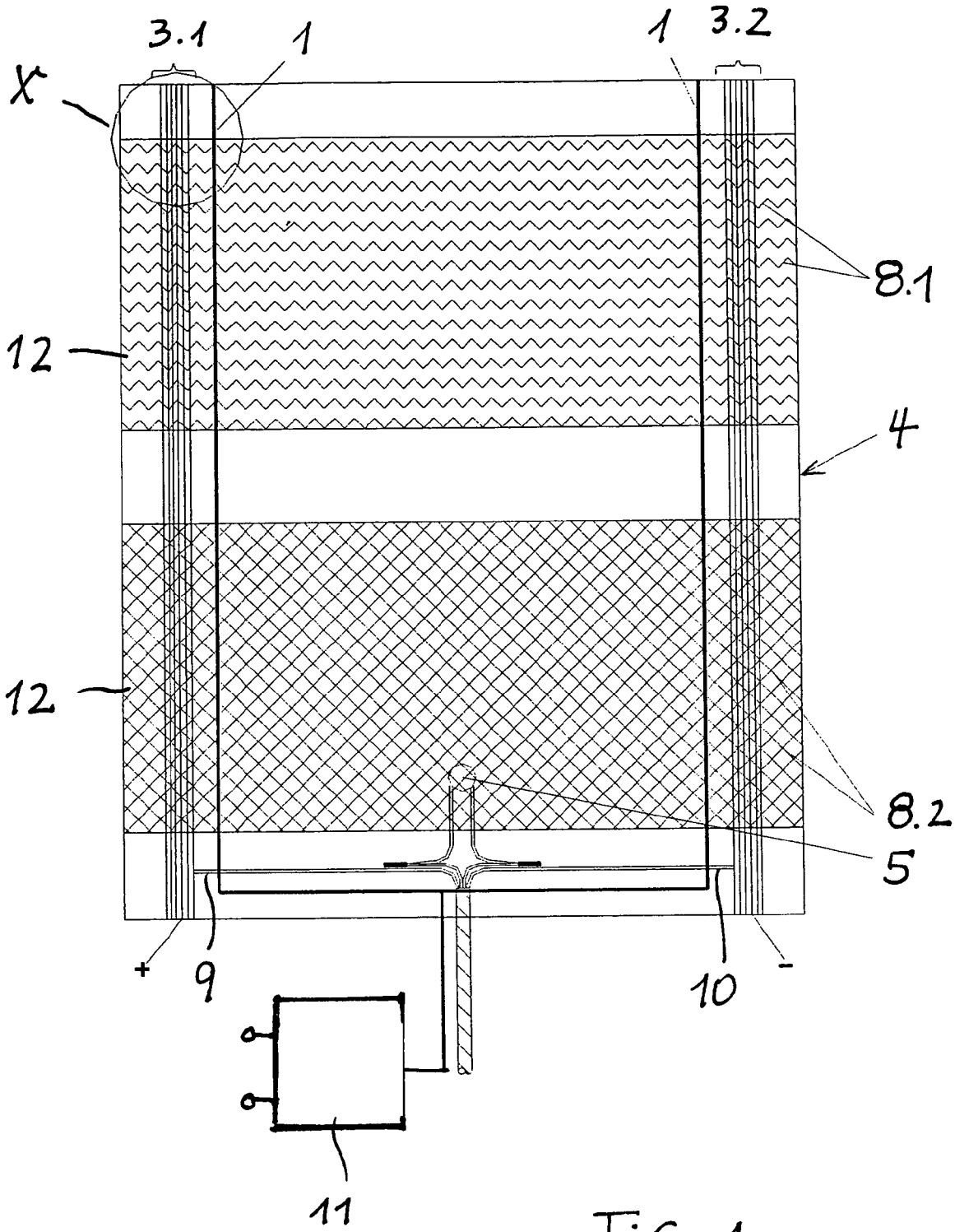
FIG. 1 is a plan view of an inventive flexible heating element.

The heating element according to FIG. 1 consists of a two-part textile surface heating element 4 whose upper part comprises a heating conductor extending in a wave-like way and whose lower part comprises heating conductors arranged in a net-like way.

At both side edges of the flexible heating element there is provided a region of contact conductors 3.1, 3.2 which, via suitable supply lines 9, 10, are connected to a voltage source (not illustrated).

In parallel to the contact conductors 3.1,3.2 in the inner region of the heating element, there is arranged one additional conductor 1 each functioning as a detection conductor. In the lower region of the heating element, approximately at the level of the supply lines 9, 10, the detection conductors come together and are connected to the evaluation unit 11.

In the present embodiment, the heating conductors 8.1, 8.2 are provided in the form of carbon heating conductors and the additional conductors 1 in the form of detection conductors extending in a straight line. However, this type of arrangement is not compulsory, but can be modified from case to case by metallic heating conductors or other heating conductor materials. Furthermore, the additional conductors can be guided across the heating element at any angle, but they should remain outside the region of the temperature sensor which, in the present embodiment, is indicated in the lower connection end of the contact conductors by a temperature sensor 5.

Figure 2:
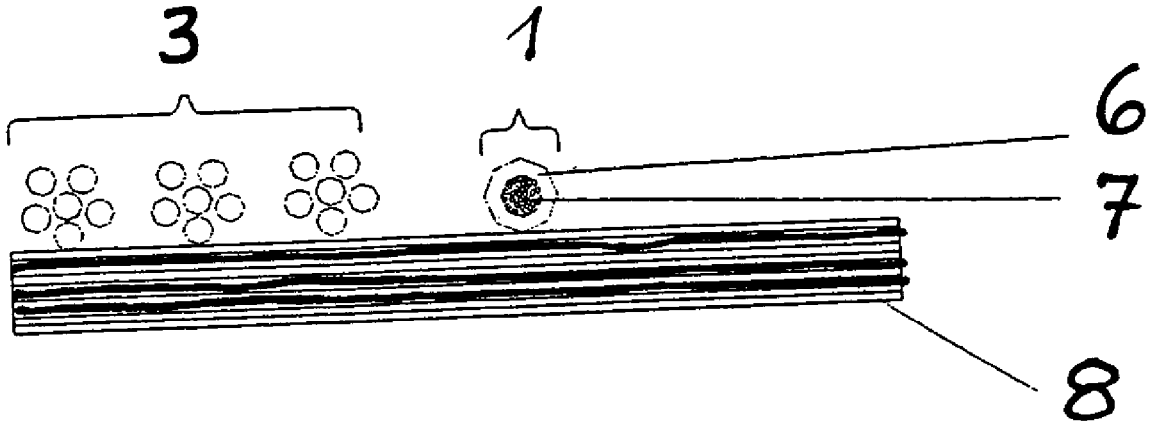
FIG. 2 is an illustration of section X of the flexible heating element according to FIG. 1 in the form of a cross-section of the surface heating element in the region of the contact conductor.

FIG. 2 shows the heating element in the form of a cross-section wherein the contact conductors 3 and the carbon heating conductors 8 are provided in the form of filaments. The additional conductor consists of a detection conductor 1 whose core consists of a steel filament 7 which is provided with a coating material consisting of a anti-melting insulation 6.

If the coating material melts at a specific temperature of the carbon heating conductor 8, the steel filaments come into contact with the energized carbon heating conductors 8. As a result, a signal is transmitted to the evaluation unit 11 so that the supply of current to the heating element can be interrupted. The risk of overheating of the heating element is thus eliminated.

Numerous different configurations and materials can be used in practicing the invention. In the preferred embodiment, the contact conductors 3.1 and 3.2 comprise metallic strands of wire. Such conductors, which are well known, comprise a multiplicity of individual strands which usually have a small diameter, for example in the range of 0.01 mm to 0.10 mm. The heating conductors 8.1 and 8.2 may be carbon fibers which contact one another at spaced contact points. Such configurations are known. The additional conductor 1 may include a filament made of steel and the insulation 6 may comprise any suitable insulating material with a melting point, for example, in the range of 110° C. to 150° C. In one embodiment, the additional conductor 1 consists of a textile thread around which one or more conductive metallic strips are wrapped to provide a conductive surface. An insulating material such as an insulating shell is then applied to the metallic wrapping.

In manufacturing the heated fabrics, both the heating conductors 8.1 and 8.2 and the contact conductors 3.1 and 3.2 may be knitted into a textile base material. After the knitting process, the additional conductor 1 may be applied to the heating conductors 8.1 and 8.2. Alternatively, the heating conductors, contact conductors and additional conductor may be sewn onto the textile base material 12.

Although the additional conductor 1 is shown in a straight configuration, numerous other configurations are also possible. For example, the additional conductor may extend in a serpentine-like fashion in the plane of the heating element 4.

The evaluation unit 11 may be a device which is commercially available. The device has a programmed level at which the heating element can be disconnected. The programmed level refers to the minimum electric current above which current flow through the heating element is indicative of overheating. When the current flow from the heating element exceeds the programmed level, this is an indication of over heating and the evaluation unit 11 sends an output signal to a switching device which disconnects the current supply from the heating element.

The monitoring device in accordance with the invention thus consists of the additional conductors in the form of detection conductors 1 and the evaluation unit 11. It can therefore be introduced into a heating element relatively easily and causes relatively low additional costs. Because of its simple design, the inventive monitoring device is not subject to failure and, during the entire service life of the surface heating element, it offers safe protection against overheating.

I claim:

1. A controlling and monitoring device for avoiding damage through overheating in the case of a flexible, textile surface heating elements which includes at least two opposed contact conductors made of electrically conducting, non-insulated fibers or wires between which there extends a plurality of heating conductors which are electrically connected to the contact conductors and to a source of electricity, and which further includes a base material, comprising:

(a) an evaluation unit connected to the source of electricity, (b) at least one additional electric conductor positioned along at least one contact conductor over the heating conductors, wherein the additional conductor is electrically insulated by a covering material and is connected to said evaluation unit, wherein (c) the covering material has a melting point which is above the heating temperature of the surface heating element, but below the permissible thermal limit temperature of the base material, and wherein the additional electric conductor is made of a material that does not melt at a temperature below the permissible thermal limit temperature of the base material, wherein, in the case of overheating, the covering material melts but the additional conductor does not melt, and (d) wherein the heating conductors, together with the additional conductor, form an electrical circuit connected to the evaluation unit for the purpose of controlling overheating.

2. A controlling and monitoring device for heating elements according to claim 1, wherein the contact conductors comprise multiple strands of metallic wire and the heating conductors comprising wave-shaped carbon fibers contacting one another at spaced contact points.

3. A controlling and monitoring device according to claim 1, wherein the additional conductor includes a filament made of steel.

4. A controlling and monitoring device according to claim 1, wherein the melting point of the covering material of the additional conductor is between 110° C. and 150° C.

5. A controlling and monitoring device according to claim 1, wherein both the heating conductors and the contact conductors are knitted into a textile base material and the additional conductor is applied to the heating conductors in the textile base material.

6. A controlling and monitoring device according to claim 1, wherein the heating conductors, the contact conductors, and the additional conductor are sewn onto a textile base material.

7. A controlling and monitoring device according to claim 1, wherein the additional conductor extends in a wave-like way in the plane of the heating element.

8. A controlling and monitoring device according to any claim 1, wherein the additional conductor consists of a textile thread which, in the direction of its axis, is surrounded by one or more electrically conducting metal strips, and an insulating layer over the metal strips.

9. A controlling and monitoring device according to claim 1, wherein the evaluation unit is connected to a control unit for separating the source of electricity from the contact conductors.

10. A controlling and monitoring device according to claim 1, wherein the control unit regulates the operating temperature of the heating element.

* * * * *